US010006470B2

(12) United States Patent
Kienzler et al.

(10) Patent No.: US 10,006,470 B2
(45) Date of Patent: Jun. 26, 2018

(54) FASTENING DEVICE FOR FASTENING A VENTILATION ARRAY TO A SEAT

(71) Applicants: DAIMLER AG, Stuttgart (DE); EBM-PAPST ST. GEORGEN GmbH & Co. KG, St. Georgen (DE)

(72) Inventors: Andreas Kienzler, St. Georgen (DE); Sven Friderich, Boeblingen (DE)

(73) Assignees: EBM-PAPST ST. GEORGEN, St. Georgen (DE); DAIMLER AG, Stuttgart (DE)

( * ) Notice: Subject to any disclaimer, the term of this patent is extended or adjusted under 35 U.S.C. 154(b) by 408 days.

(21) Appl. No.: 14/434,402

(22) PCT Filed: Jun. 14, 2013

(86) PCT No.: PCT/EP2013/062450

§ 371 (c)(1),
(2) Date: Apr. 8, 2015

(87) PCT Pub. No.: WO2014/056638

PCT Pub. Date: Apr. 17, 2014

(65) Prior Publication Data

US 2015/0285266 A1 Oct. 8, 2015

(30) Foreign Application Priority Data

Oct. 12, 2012 (DE) ..... 20 2012 103 921 U

(51) Int. Cl.
*F04D 29/64* (2006.01)
*F04D 29/60* (2006.01)
(Continued)

(52) U.S. Cl.
CPC ..... *F04D 29/601* (2013.01); *F04D 19/002* (2013.01); *F04D 29/522* (2013.01); *F04D 29/703* (2013.01)

(58) Field of Classification Search
CPC .... F04D 29/601; F04D 29/552; F04D 29/703; F04D 19/002; B60N 2/5657
See application file for complete search history.

(56) References Cited

U.S. PATENT DOCUMENTS 6,737,615 B2 5/2004 Lange ..... 219/536
6,814,542 B2 11/2004 Marlander ..... 415/219.1
(Continued)

FOREIGN PATENT DOCUMENTS

CN 1869456 A 11/2006
CN 1873233 A 12/2006
(Continued)

OTHER PUBLICATIONS

SIPO Search Report of Jun. 23, 2016 in App # 2013-8006-4502.4 (Chinese text).

(Continued)

*Primary Examiner* — Richard Edgar
(74) *Attorney, Agent, or Firm* — Milton Oliver; Oliver Intellectual Property

(57) ABSTRACT

A mounting apparatus (30) for mounting a fan arrangement (40) on a seat (100), for example a vehicle seat, features a cylindrical sleeve or installation element (10) which secures within the seat, and a fan housing (50) for the fan arrangement or module (40), which slides into, and latches within, the cylindrical sleeve (10). The fan housing (50) has a tubular housing part (54) having a first housing part end (51) and a second housing part end (52) located axially opposite it. The fan module (40) includes a centrally located fan (80,81) supported by a plurality of radial struts (86), at least one of which serves as a channel (89) for power supply connecting wires (92). Wire pass-through openings (26, 64,
(Continued)

64') are configured to permit a partial rotation of the fan module (40) during installation into the cylindrical sleeve (10).

20 Claims, 12 Drawing Sheets

(51) Int. Cl.

| | |
|---|---|
| ***F04D 19/00*** | (2006.01) |
| ***F04D 29/52*** | (2006.01) |
| *F04D 29/70* | (2006.01) |

(56) References Cited

U.S. PATENT DOCUMENTS

| | | | | |
|---|---|---|---|---|
| 7,560,663 | B2 | 7/2009 | Schehr | 219/202 |
| 8,167,368 | B2 | 5/2012 | Eckel | 297/180.14 |
| D701,954 | S | 4/2014 | Kienzler | D23/414 |
| 2010/0072186 | A1 | 3/2010 | Schehr | 219/217 |
| 2010/0300648 | A1 | 12/2010 | Grantham | 165/55 |
| 2012/0195776 | A1 | 8/2012 | Ragg | 417/423.7 |
| 2013/0323096 | A1 | 12/2013 | Mueller | 417/368 |

FOREIGN PATENT DOCUMENTS

| | | | | |
|---|---|---|---|---|
| CN | 101804775 | A | 8/2010 | |
| CN | 102474153 | A | 5/2012 | |
| CN | 202 326 426 | U | 7/2012 | |
| CN | 102536859 | A | 7/2012 | |
| DE | 69922349 | T2 | 6/2000 | |
| DE | 199 25 439 | A | 12/2000 | |
| DE | 20 2005 012 394 | U | 12/2005 | |
| DE | 10 2007 006 058 | A1 | 8/2008 | |
| DE | 10-2007-006058 | A | 8/2008 | |
| DE | 10 2011 109 570 | A1 | 8/2011 | |
| DE | 10-2011-109 570 | A | 3/2012 | |
| DE | 102011109570 | A1 * | 3/2012 | B60N 2/5635 |
| DE | 10-2012-005829 | A | 9/2012 | |
| GB | 2079372 | A | 1/1982 | |
| WO | WO 99-22145 | A | 5/1999 | |

OTHER PUBLICATIONS

SIPO Search Report of Jun. 23, 2016 in App # 2013-8006-4502.4 (English text).

* cited by examiner

FASTENING DEVICE FOR FASTENING A VENTILATION ARRAY TO A SEAT

CROSS-REFERENCE

This application is a section 371 of International Application PCT/EP2013/062450, filed 2013 Jun. 14, and further claims priority from German application 20 2012 103 921.4, filed 2012 Oct. 12.

FIELD OF THE INVENTION

The invention relates to a mounting apparatus for mounting a fan arrangement on a seat, for example a seat of a car, truck or airplane.

BACKGROUND

When installing seats, upholsterers or vehicle fitters work in part in rough fashion with hammers, in order to pull the seat covering onto the seat. With seats that have a built-in fan for ventilating the seat, damage to the fan can therefore occur.

SUMMARY OF THE INVENTION

An object of the invention is therefore to make available a novel mounting apparatus for mounting a fan arrangement on a seat.

This object is achieved by a mounting apparatus having a generally cylindrical installation sleeve element which secures within the seat, and a concentrically smaller cylindrical fan arrangement which slides into, and latches within, the installation element. Protective grills or grids are provided at each axial end of the apparatus to protect against insertion of fingers or other body parts into the path of blades of the fan. Spring elements are provided to maintain the fan securely within the sleeve.

Further details and advantageous refinements of the invention are evident from the exemplifying embodiments, in no way to be understood as a limitation of the invention, that are described below and depicted in the drawings.

BRIEF FIGURE DESCRIPTION

Figure 1:
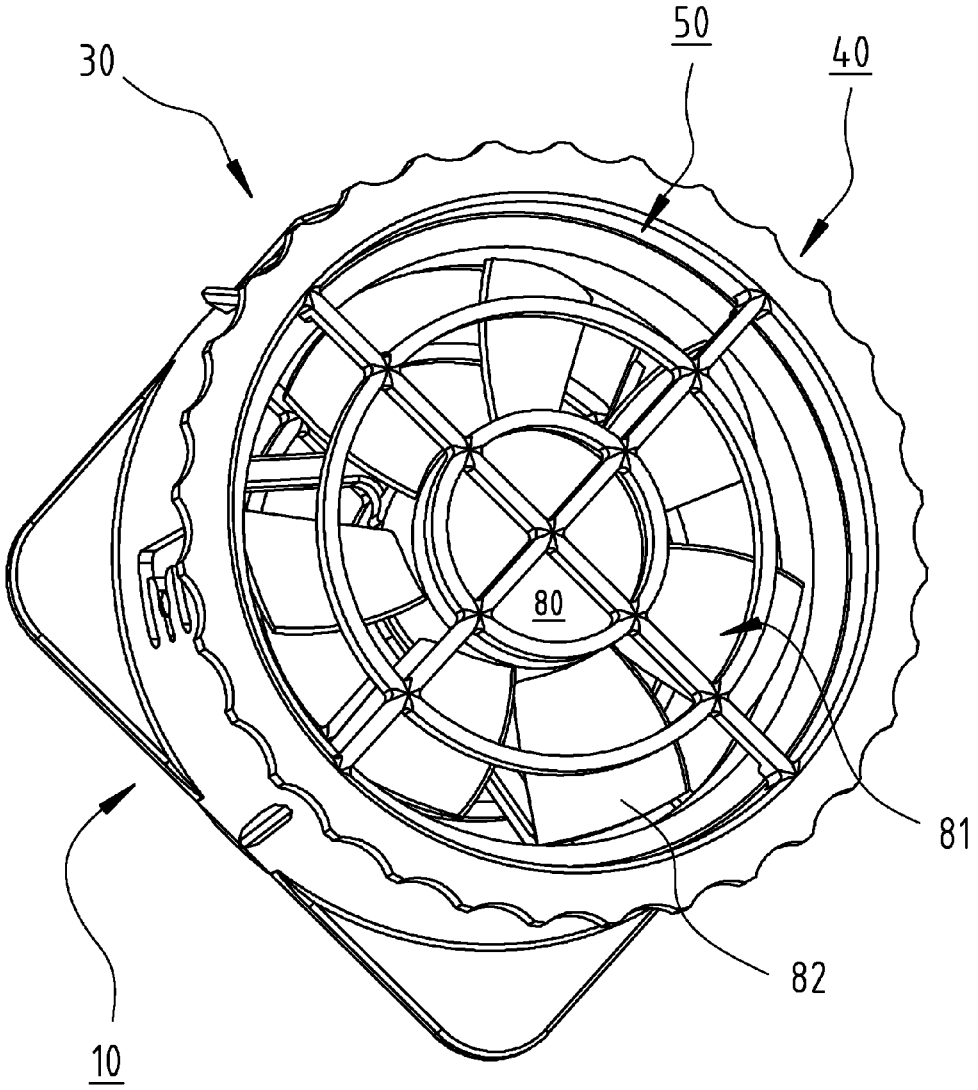
FIG. 1 is a three-dimensional depiction of an installation element having a fan arrangement arranged thereon.
Figure 6:
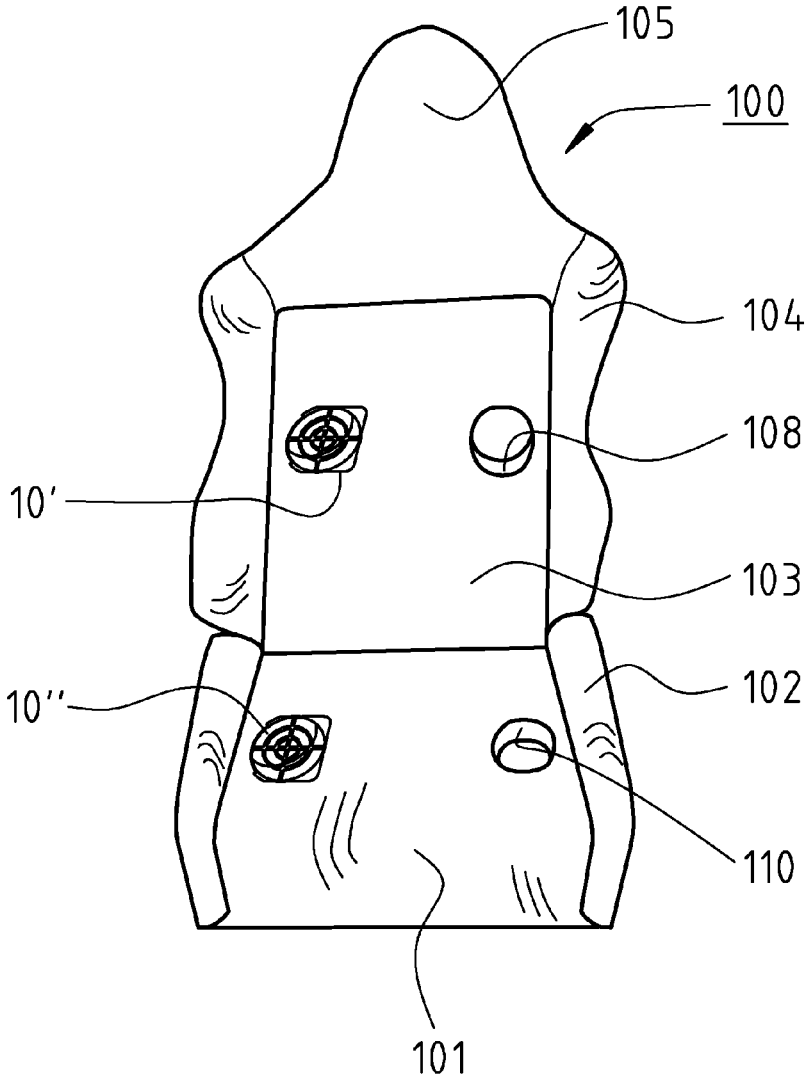
Figure 7:
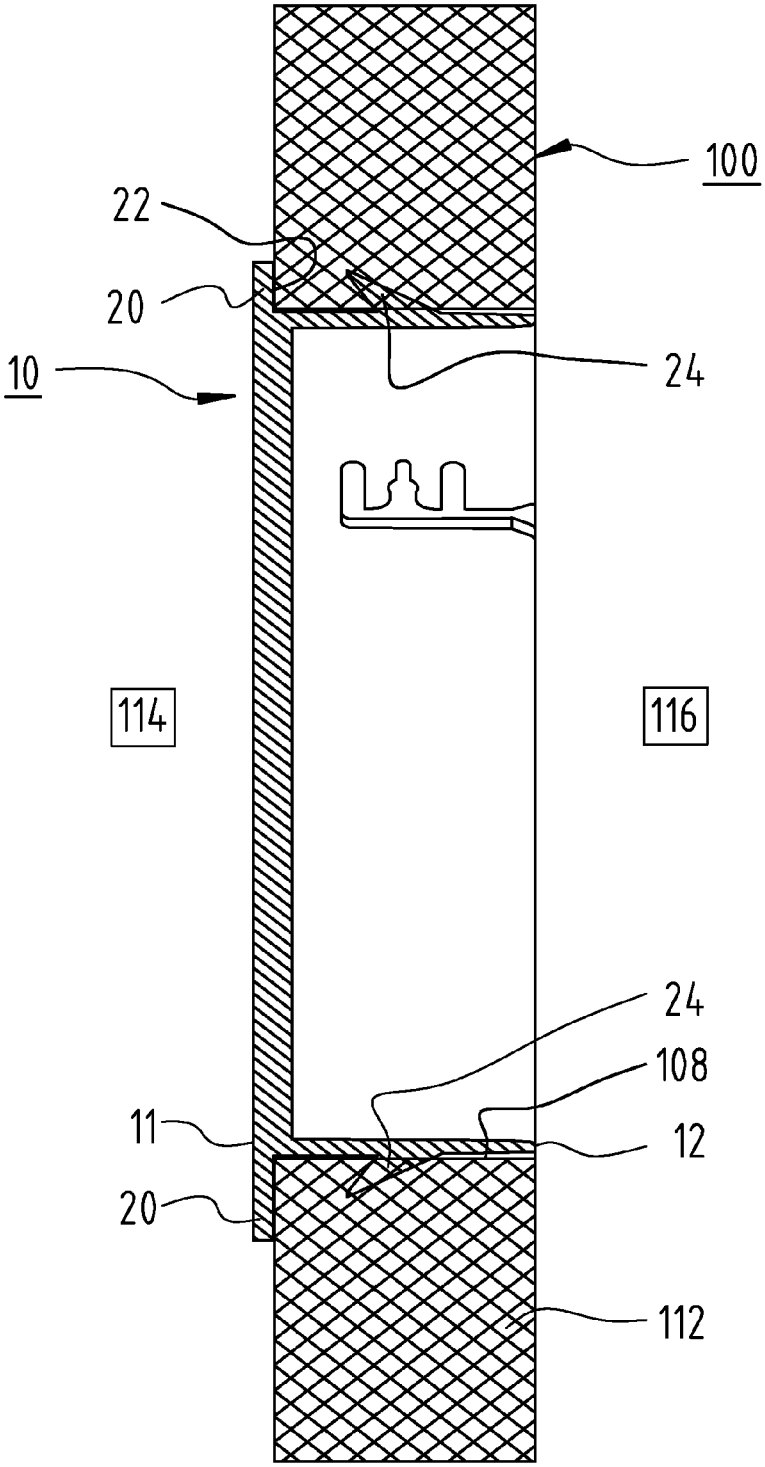
Figure 8:
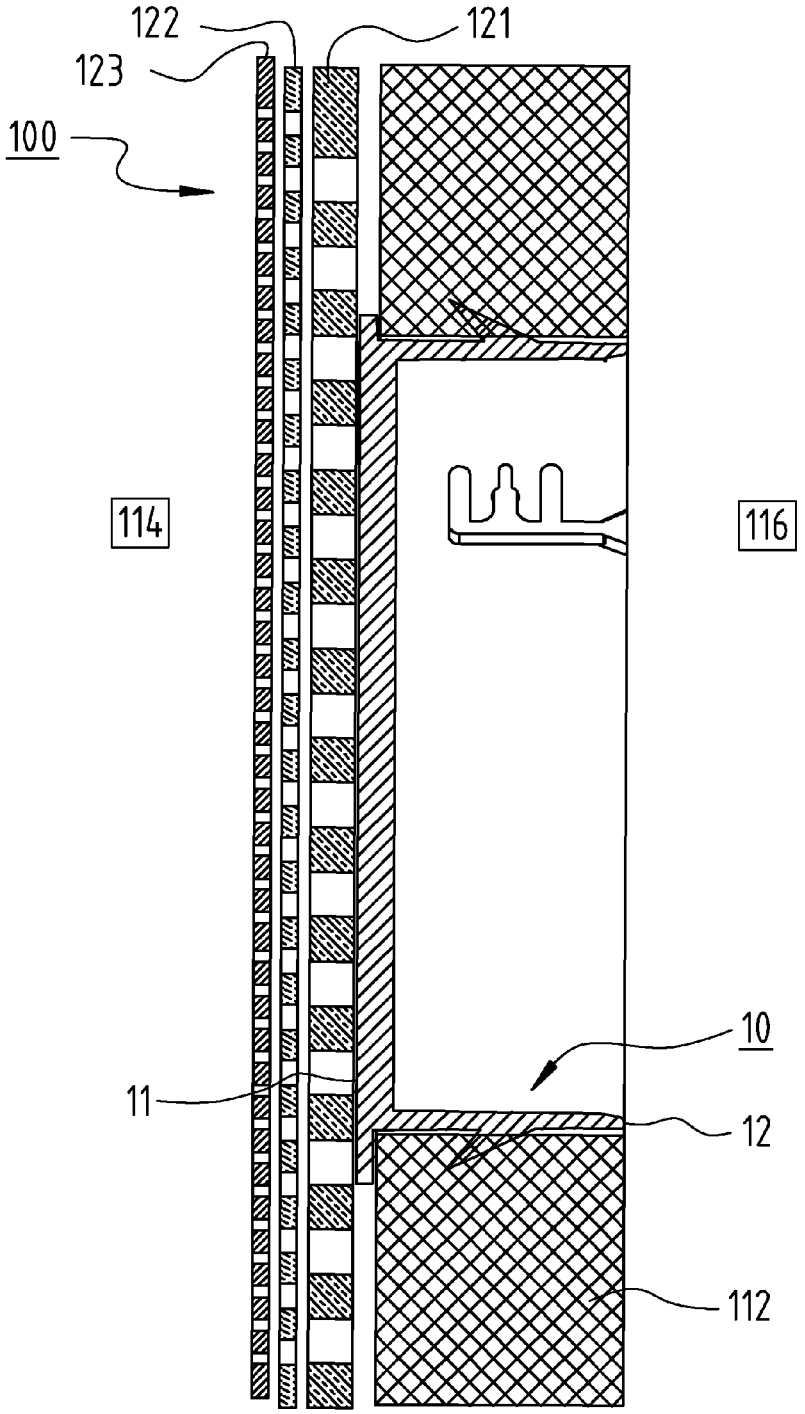
Figure 9:
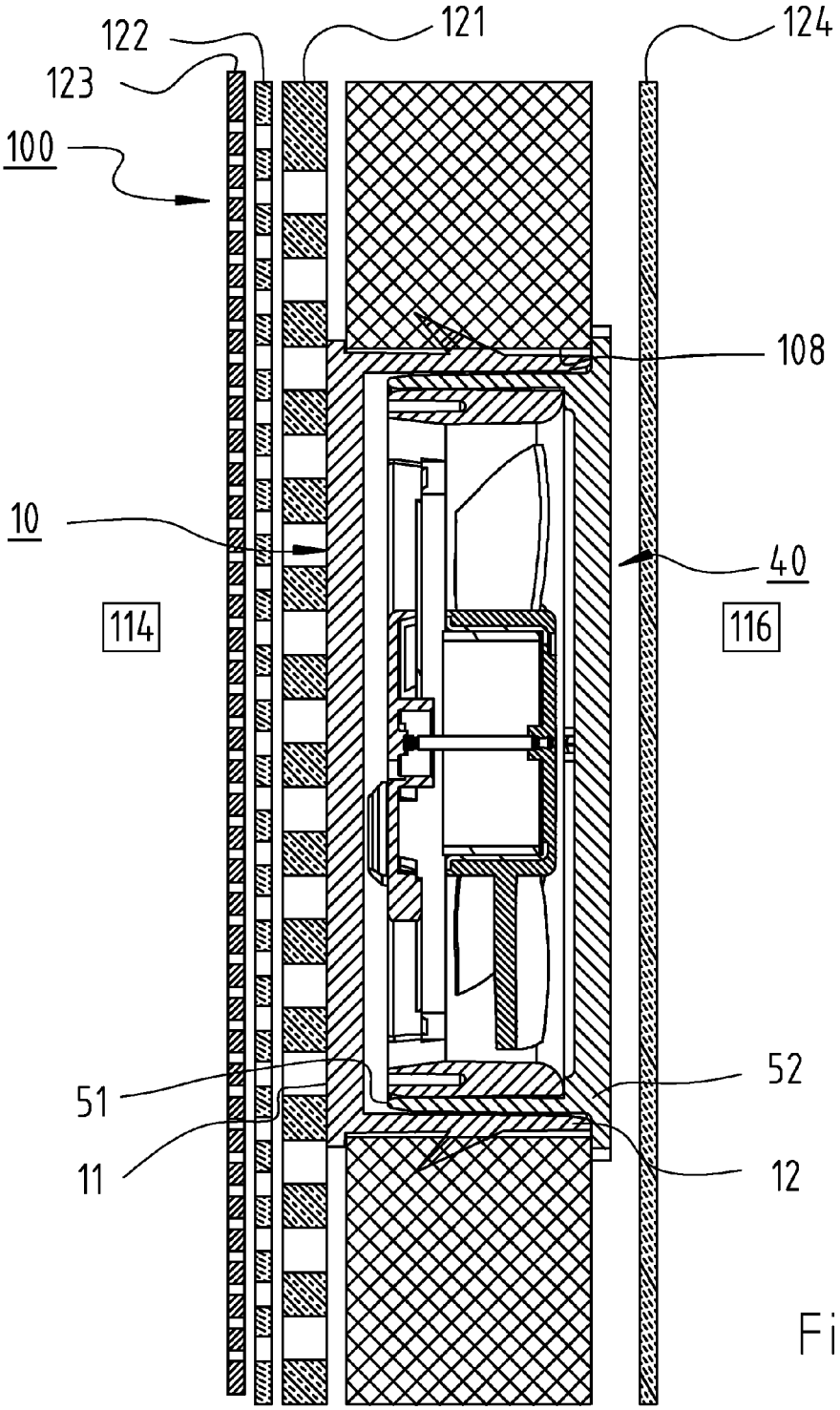
Figure 10:
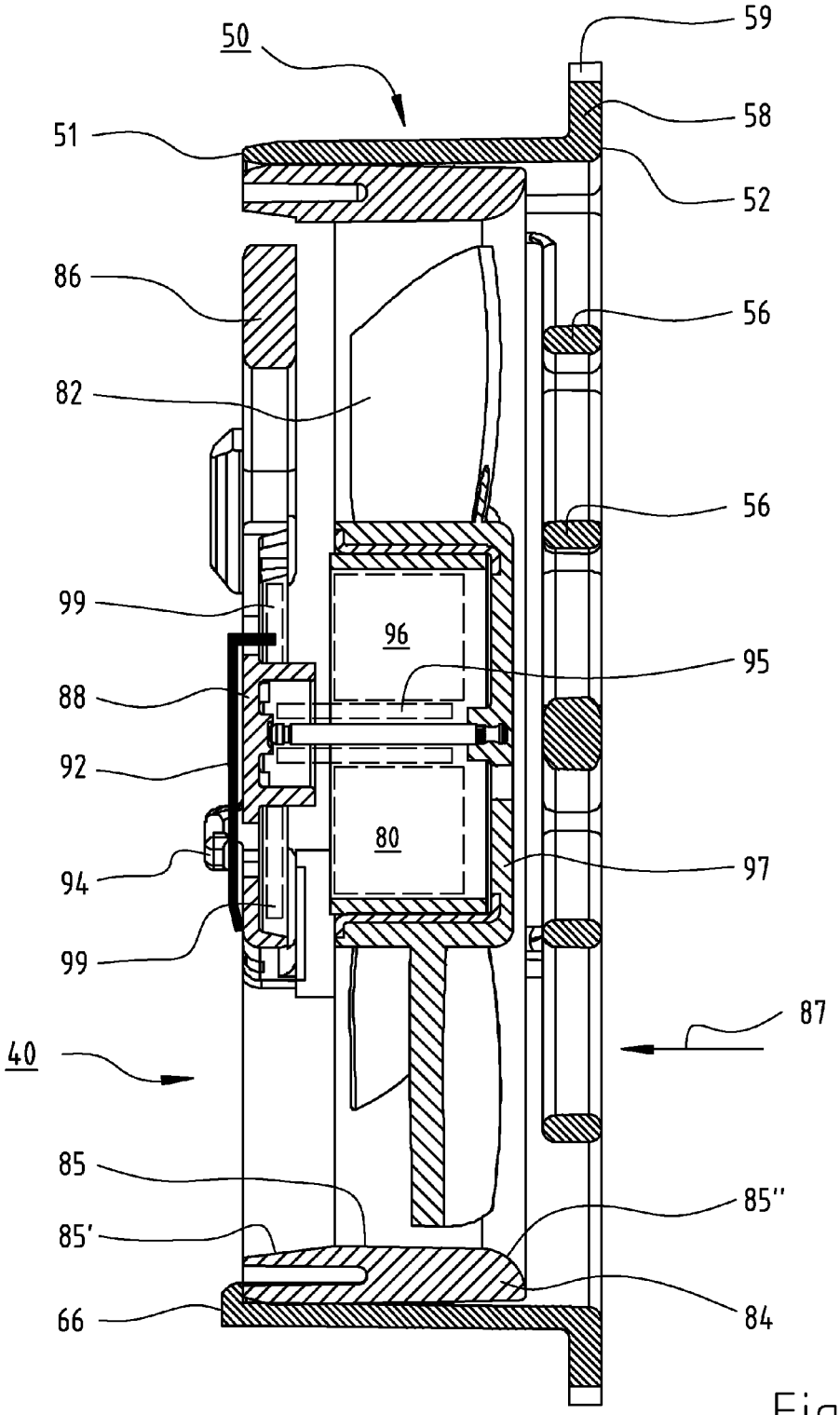
Figure 11:
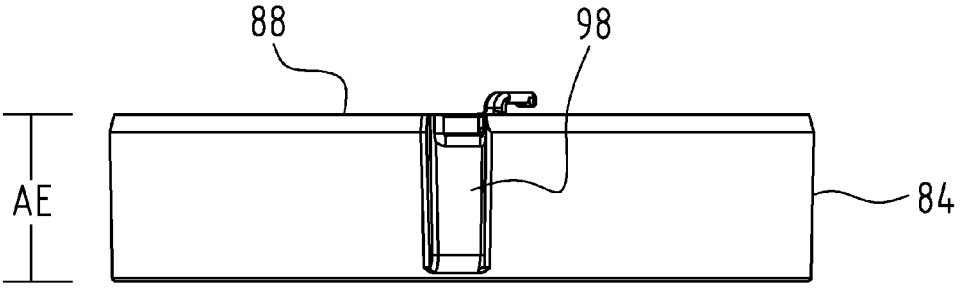
Figure 12:
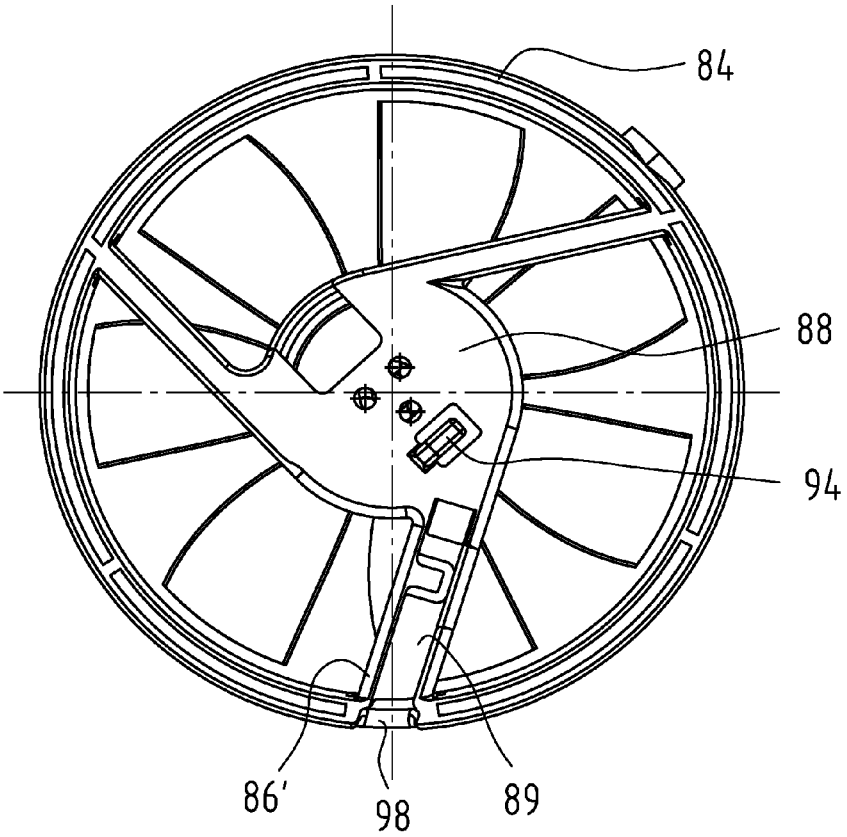
Figure 13:
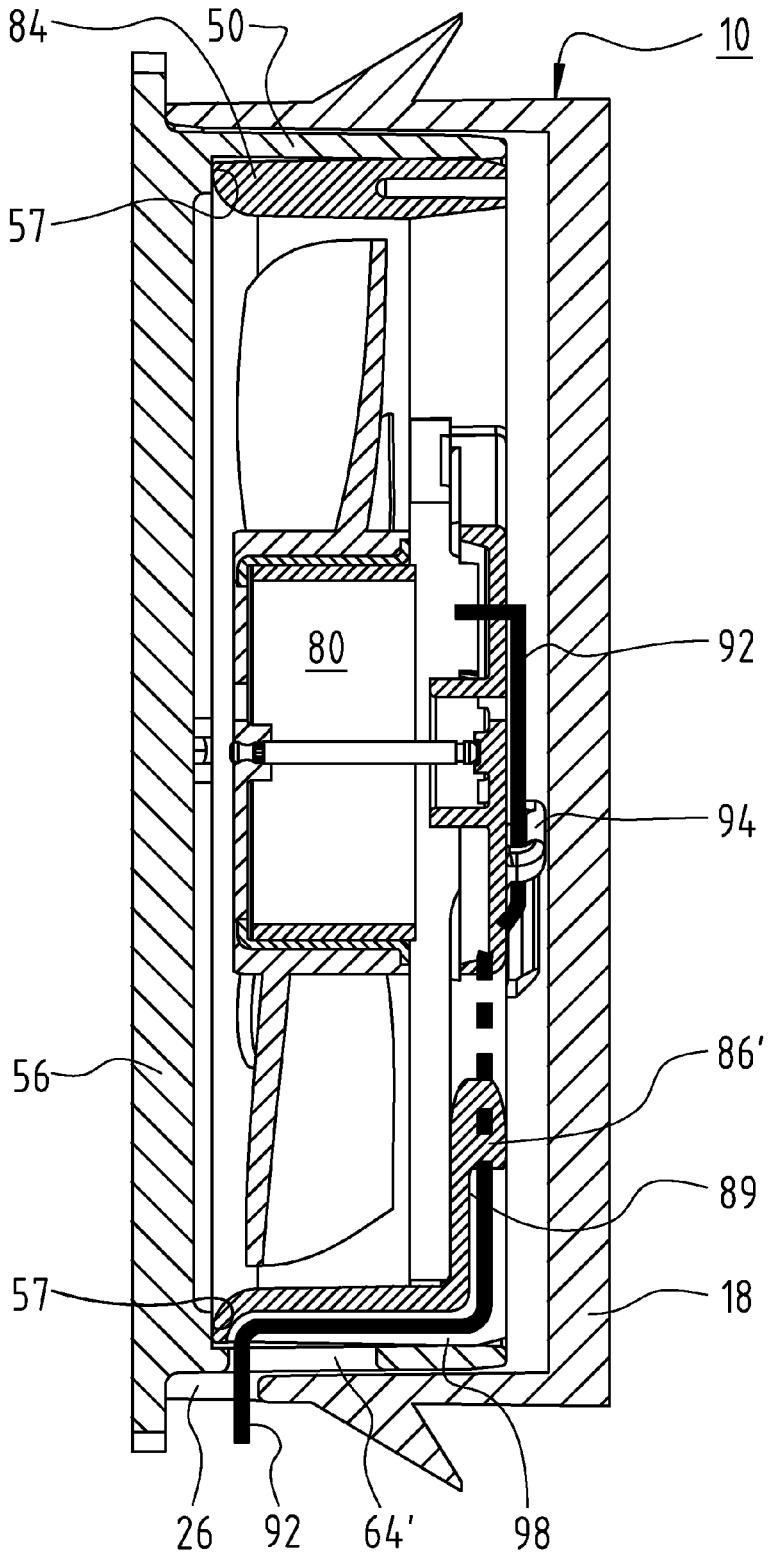
Figure 14:
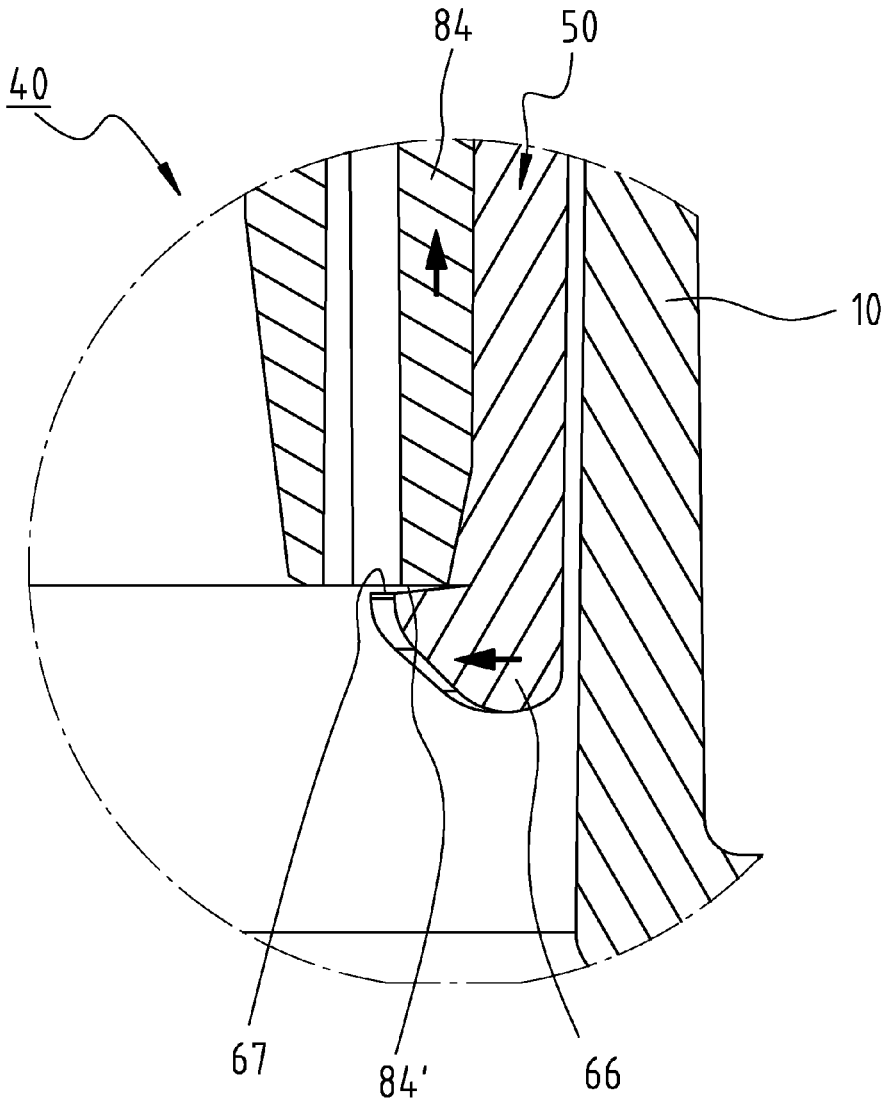

FIG. 6 schematically depicts a vehicle seat having installation elements according to FIG. 1;

FIG. 7 is a section through the vehicle seat of FIG. 6 with the installation element according to FIG. 1;

FIG. 8 is a section in accordance with FIG. 7 with layers (coverings);

FIG. 9 is a section in accordance with FIG. 8 after installation of the fan arrangement of FIG. 1;

FIG. 10 is a section through the fan arrangement of FIG. 1;

FIG. 11 is a side view of an air guidance part of the fan arrangement of FIG. 1;

FIG. 12 is a plan view of the air guidance part of FIG. 11;

FIG. 13 is a section through the installation element and the fan arrangement of FIG. 1, inverted with respect to the FIG. 9 configuration; and FIG. 14 shows a portion of the connection between the air guidance part and the fan housing of the fan arrangement of FIG. 1.

DETAILED DESCRIPTION

FIG. 1 shows a mounting apparatus 30 having an installation element 10 and a fan housing 50. Fan housing 50 is part of a fan arrangement 40 having a fan 81 that is arranged in the installation element. Fan 81 has an electric motor 80 and fan blades 82.

Figure 2:
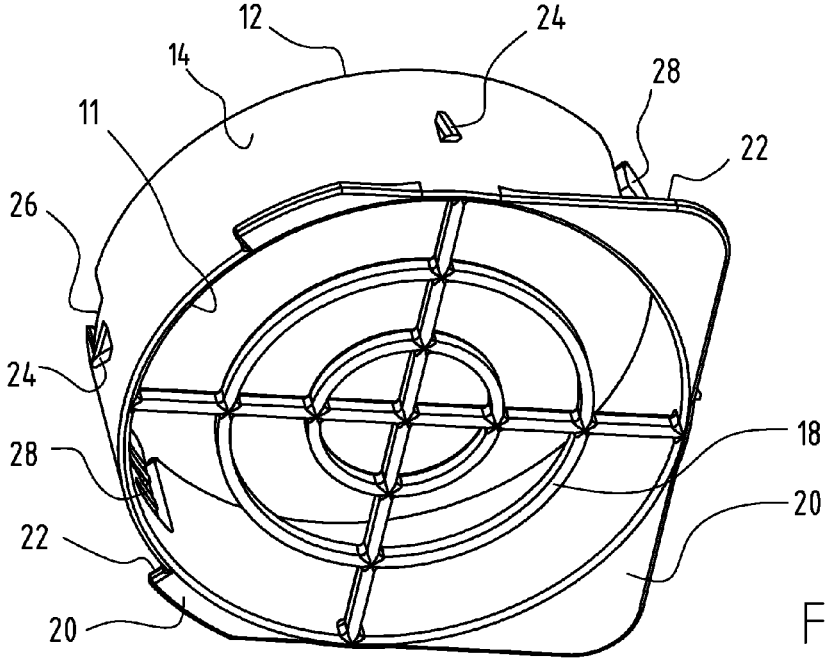
FIG. 2 is a three-dimensional depiction of the installation element of FIG. 1.

FIG. 2 shows installation element 10. This has a tubular installation part (also called a "sleeve") 14 having a first end 11 and a second end 12 located opposite it. A protective grid 18, which enables the transport of air through tubular installation part 14, is provided at first end 11. At least one outwardly projecting flange 20, which has on side 22 facing toward second end 12 an abutment surface 22, is preferably provided at the first end on the outer side. Flange 20 is implemented, by way of example, to be larger on the right side than on the left side, and flange 20 can run around the entire periphery of tubular installation part 14 or only around parts thereof. In other words, the radial extent of flange 20 is preferably smaller in a first angular region than in a second angular region; more preferably, no flange is provided in at least one third angular region. Mounting elements 24, which are preferably implemented as hook-shaped elements 24, are provided on the outer side of tubular installation part 14.

The outside diameter of tubular installation part 14 is preferably in the range from 4 to 10 cm, more preferably in the range from 6 to 8 cm.

Tubular installation part 14 preferably has at least one spring element 28 for a latching connection, more preferably at least two spring elements 28.

A cutout 26 is provided at second end 12 in order to enable the passage of wires in this region.

Figure 3:
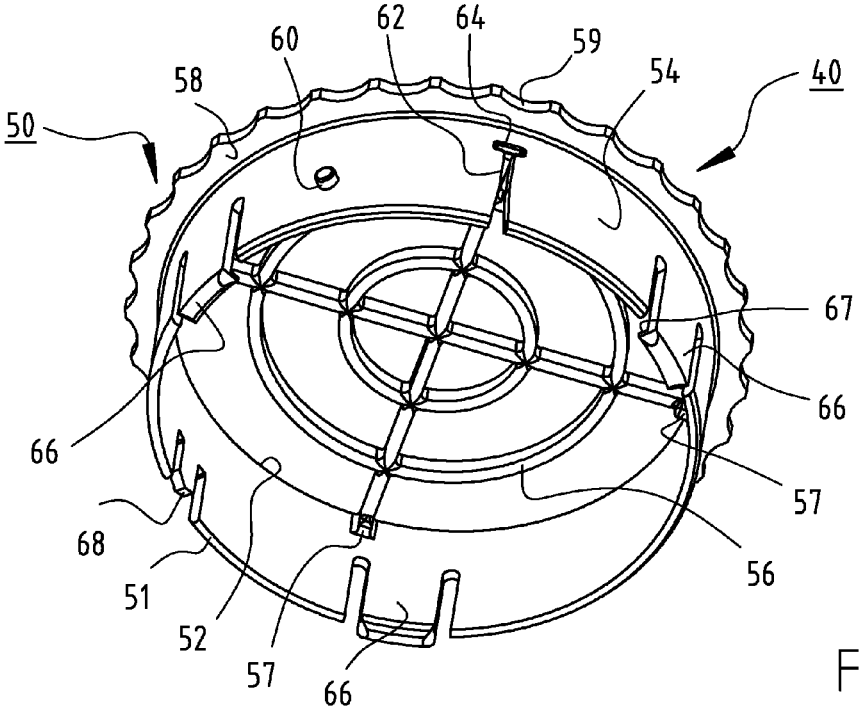
FIG. 3 is a three-dimensional depiction of a first exemplifying embodiment of a fan housing of the fan arrangement of FIG. 1.

FIG. 3 shows a fan housing 50 that can be mounted in installation element 10 of FIG. 1. Fan housing 50 has a first end 51 and a second end 52 located opposite it. A protective grid 56 that enables the transport of air through tubular housing part 54 is provided at second end 52. At least one stop 57 is provided in order to limit movement of an air guidance part 84 (see FIG. 13) in an axial direction. A plurality of radially protruding connecting parts (transverse pegs) 60 are arranged on the outer side of tubular housing part 54. An outwardly projecting collar 58, which enables the fan housing to be grasped and turned by hand, is preferably provided at the second end. The radially outer contour 59 of collar 58 is preferably of undulating configuration.

Arranged on tubular housing part 54 are latching elements 66 that can deflect radially outward upon insertion of a tubular part 84 (see FIG. 5) from first side 51.

An aperture 64, which serves to guide wires 92 of motor 80 (see FIG. 10) outward through tubular housing part 54, is provided in tubular housing part 54. Aperture 64 is connected to an elongated opening 62 that extends from first end 51 of tubular housing part 54 toward second end 52. In other words, elongated opening 62 has, at its end facing toward second end 52 of tubular housing part 54, an enlargement 64 in a circumferential direction.

Elongated opening 62 preferably extends over at least half the axial extent between first end 51 and second end 52 of tubular housing part 62.

A cutout 68 having a predetermined shape is provided in tubular housing part 54, cutout 68 preferably being open toward first side 51.

Figure 4:
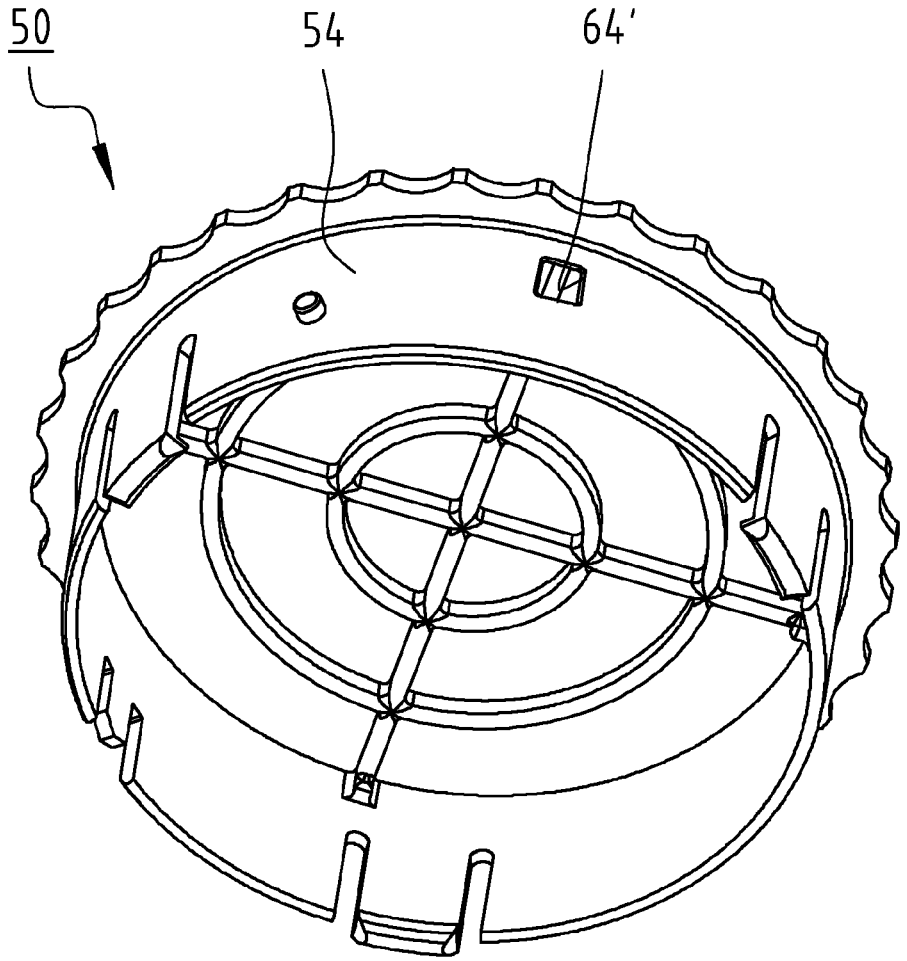
FIG. 4 is a three-dimensional depiction of a second exemplifying embodiment of a fan housing of the fan arrangement of FIG. 1.

FIG. 4 shows a variant of fan housing 50 in which a cutout 64', such as a window, is provided in tubular housing part 54. A portion of protective grid 56 is visible through cutout 64'. Cutout 64' serves to enable the passage of wires 92 (see FIG. 10) through tubular housing part 54.

Figure 5:
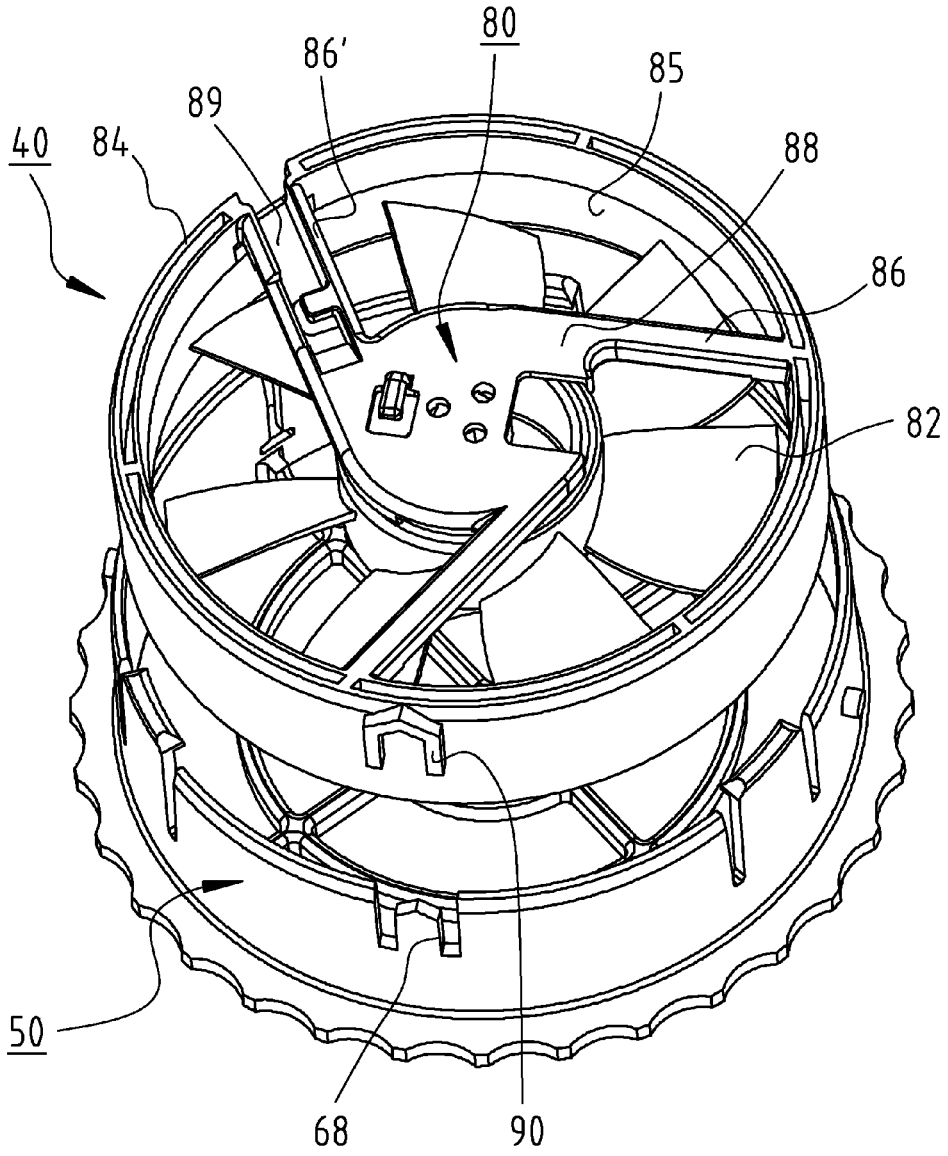
FIG. 5 depicts the fan arrangement of FIG. 1 before installation.

FIG. 5 shows fan arrangement 40, with fan housing 50 and electric motor 80, prior to installation. A tubular air guidance part 84 is connected via struts 86, 86' to a flange (motor carrier) 88. Struts 86 allow air to be transported through tubular air guidance part 84. At least one strut 86' preferably has a channel 89 in order to guide wires 92 (see FIG. 10) from motor 80 to air guidance part 84. Electric motor 80 is mounted on flange 88, and electric motor 80 drives fan blades 82 in air guidance part 84. Inner side 85 of tubular air guidance part 84 is preferably shaped in accordance with aerodynamic considerations. A radially protruding indexing element 90 of predetermined shape, which preferably has a shape complementary to cutout 68 of fan housing 50, is provided on the outer side of tubular air guidance part 84.

FIG. 6 schematically depicts a seat 100 that can be used, for example, for vehicles (passenger cars, commercial vehicles, boats) or also for office chairs. Seat 100 has a seat surface (seat shell) 101 and a backrest (back shell) 103. A headrest 105 is provided in the upper region of backrest 103.

For increased comfort, lateral bolsters 102 are preferably provided on seat surface 101, and lateral bolsters 104 on backrest 103, in order to offer lateral retention. On the right side, an opening 108 is provided in backrest 103 and an opening 110 is provided in seat surface 101. Corresponding openings 108, 110, into each of which an installation element 10', 10" is inserted, are provided on the left side.

FIG. 7 is a section through installation element 10' that is pressed into opening 108. Seat 100 has a base layer 112 that either is itself dimensionally stable or is stabilized by means of a metal framework. A foam layer (foam support) or a rubberized hair layer can be used, for example, as a material for base layer 112. Such materials are already fairly hard or stiff. The seat side is labeled 114, and the back side 116. Installation element 10 has been pressed into aperture 108 from seat side 114. Hook-shaped elements 24 act in this context as barbs. They allow inward pressing toward back side 116 but prevent installation element 10 from slipping out toward seat side 114. The pushing in of installation element 10 is preferably limited by flange 20 as soon as flange 22 abuts against base layer 112.

After insertion into vehicle seat 100, installation element 10 is preferably secured both against axial shifting (in both directions) and against rotation in opening 108.

With simple seats 100, seat side 114 of FIG. 7 can be used directly.

FIG. 8 shows a seat 100 that, in order to increase comfort, has been covered with further layers 121, 122, and 123 after the installation of installation element 10.

Layer 121 is a knitted spacer fabric, i.e. is intended to produce a spacing between base layer 112 and installation 10 and to make seat 10 softer.

Layer 122 is on layer 121 and is made, for example, of foam, in particular recycled foam.

A perforated leather covering is used, for example, as outermost layer 123.

Layers 121, 122, and 123 are preferably air-permeable, for example as a result of perforations.

When covering seats 100, seat manufacturers in some cases work roughly with rubber hammers so that the coverings can be stretched on with no creases. In such cases, protective grid 18 must be of correspondingly stable design.

Because back side 116 of the seat is still accessible once front side 114 of seat 100 has been covered, fan arrangement 40 can be installed after seat 100 has been upholstered. This additionally reduces the risk of damage to fan arrangement 40, and also allows later access to fan arrangement 40, for example for repair purposes. In addition, chemicals such as spray adhesives or impregnation agents can be applied onto seat 100 before fan arrangement 40 is installed in installation element 10. This is a great advantage over previous fans, with which installation had to be accomplished before seat 100 was covered; and with previous fans each fan then needed, for example, to be covered over with a cardboard lid.

FIG. 9 shows vehicle seat 100 after the installation of fan arrangement 40 in installation element 10.

Fan arrangement 40 is slid from back side 116 into installation element 10 and latched to it. For this, preferably transverse pegs 60 of fan housing 50 (see FIG. 3) are latched into spring elements 28 of installation element 10 by rotating the fan arrangement 40 (see FIG. 2).

Since installation element 10 can no longer be held from seat side 114, because of layers 121, 122, 123, it is advantageous if installation element 10 is arranged or secured in cutout 108 axially non-displaceably and also non-rotatably. It is thereby easily possible to insert fan arrangement 40 into the installation element with one hand and mount it by rotation.

After the installation of fan arrangement 40, a lining 124 can optionally be applied on back side 116.

FIG. 10 shows fan arrangement 40 in which air guidance part 84 with electric motor 80 is mounted in fan housing 50. Inner side 85 of air guidance part 84 is preferably embodied in both axial end regions as a Venturi channel, i.e. it widens toward each axial end into regions 85', 85". An arrow 87 indicates the preferred flow direction of the air. Electric motor 80, which comprises a schematically indicated stator 96 and a rotor 97 as well as a schematically indicated bearing arrangement 95, is mounted on flange 88. Fan blades 82 are connected to rotor 97. Schematically indicated wires 92 extend from stator 96, or from a circuit board 99 associated with stator 96, via a wire holding apparatus 94 and via a strut 96 to the outside.

In an alternative embodiment, fan housing 50 can be connected to flange 88 directly via struts 86.

FIG. 11 shows air guidance part 84 from the side. A channel (or an elongated recess) 98 is provided on the outer side of air guidance part 84. Channel 98 proceeds in an axial direction and preferably extends over at least two-thirds of the axial extent AE of air guidance part 84.

FIG. 12 is a plan view of air guidance part 84 with electric motor 80, viewed from the flange 88 side. Wires 92 (see FIG. 10) can thus be guided via wire holding apparatus 94 and via channel 89 in strut 86' to channel 98, and can extend there, for example, in an axial direction (see FIG. 11 and FIG. 13).

Installing Motor 80 in Fan Housing 50

FIG. 13 shows a corresponding run of wires 92, the non-visible part of wires 92 being depicted with a dashed line. Wires 92 proceed from motor 80 via wire holder 94, via channel 89 in strut 86', to air guidance part 84, then turn into channel 98, run through the latter—from that half of fan housing 50 which faces toward first end 51 to that half of fan housing 50 which faces toward second end 52, preferably in a substantially axial direction (or slightly obliquely)—then turn downward (as depicted in FIG. 13), proceed through window 64' (see FIG. 4) of fan housing 50, and then through cutout 26 of installation element 10 to the outer side of installation element 10.

Wires 92 of motor 80 must be passed or threaded or pulled through cutout (window) 64' (see FIG. 4) before air guidance part 84 is mounted in fan housing 50. It is thereby possible to ensure that after being threaded through, wires 92 can no longer be pulled out of cutout 64' by pulling on the outer ends of wires 92, which simplifies installation and decreases the risk of error. Fans are often held by the wires during installation.

With the variant according to FIG. 3, upon insertion of air guidance part 84 into fan housing 50, wires 92 can simultaneously be introduced through elongated opening 62 into cutout 64. Threading through the cutout 64' (see FIG. 4) can thereby be eliminated, and cutout 64 can be made smaller than cutout 64'. Wires 92 are held by the enlargement of cutout 64 in a circumferential direction. In addition, a barb (not depicted) can be provided in order to allow wires 92 to be introduced through the elongated opening (62) but prevent wires 92 from slipping out.

Air guidance part 84 is then introduced into fan housing 50, axial movement being limited by the at least one stop 57 as soon as air guidance part 84 abuts against the at least one stop 57.

FIG. 14 shows a portion of fan arrangement 40 with latching elements 66 of fan housing 50 which secure air guidance part 84 in an axial (and optionally also radial) direction. Latching elements 66 preferably have a contact surface 67 that is oblique with respect to the axial end surface (contact countersurface) 84' of air guidance part 84. The angle between axial end surface 84' and contact surface 67 is therefore greater than 0°. The result is that latching element 66 deflects toward the center only until air guidance part 84 is pushed completely inward axially, thus taking any play out of the connection between air guidance part 84 and fan housing 50. The axial extent of oblique contact surface 67 does not need to be large, and can be, for example, 0.2 mm.

Contact surface 67 is preferably not perpendicular to the rotation axis of fan 81, in order to reduce the play at end surfaces 84' of air guidance part 84 which are perpendicular to the rotation axis of fan 81.

Many variants and modifications are of course possible in the context of the present invention.

For example, the arrangement with transverse pegs 60 on fan housing 50 and spring elements 28 on installation element 28 can also be embodied the other way around, so that transverse pegs 60 are arranged on the inner side of installation element 28 and the latching elements are arranged on fan housing 50, for example at the corresponding locations as in the exemplifying embodiment above. Latching of fan housing 50 in installation element 28 is possible in this manner as well.

The description and the drawings show a mounting apparatus 30 for mounting a fan arrangement 40 on a seat 100, which mounting apparatus 30 comprises an installation element 10 and a fan housing 50 for fan arrangement 40, fan housing 50 comprising a tubular housing part 54 having a first housing part end 51 and a second housing part end 52 located opposite it, a protective grid 56 being provided at second housing part end 52, said grid being implemented to enable the transport of air through tubular housing part 54, and installation element 10 comprising a tubular installation part 14 having a first installation part end 11 and a second installation part end 12 located opposite it, a protective grid 18 being provided at first installation part end 11, said grid being implemented to enable the transport of air through tubular installation part 14; at least one outwardly projecting flange 20, which is implemented to form, upon installation of installation element 10 with a surface 22 facing toward second installation part end 12, a stop relative to an element of seat 100, being provided at first installation part end 11 on the outer side of tubular installation part 14; and installation element 10 being embodied in such a way that after installation thereof on a seat 100, introduction of tubular housing part 54 of fan housing 40 into tubular housing part 54 from second installation part end 12 is possible.

Preferably the installation element comprises at least one mounting element 24, 22 that is implemented to secure installation element 10 axially in an aperture of seat 100.

Preferably the at least one mounting element 24, 22 is implemented to secure installation element 10 against rotation in an aperture of seat 100.

Preferably the at least one mounting element 24, 22 comprises a hook-shaped element 24 that is implemented to enable introduction of installation element 10 into the aperture of seat 100 in a direction from first installation part end 11 toward second installation part end 12, but to counteract a movement in the opposite direction.

Preferably the radial extent of flange 20 is smaller in a first angular region than in a second angular region, preferably no flange being provided in at least one third angular region.

Preferably installation element 10 is provided for mounting a fan arrangement 40 having connecting wires 92, a first cutout 26 being provided at second installation part end 12 in order to enable connecting wires 92 to be arranged in said first cutout 26 upon mounting of fan arrangement 40.

Preferably the installation element is implemented to enable, for installation of fan arrangement 40, a rotary movement of fan housing 50 relative to installation element 10, first cutout 26 being sufficiently large that in the context of the rotary movement, a rotary movement of the connecting wires inside first cutout 26 is possible.

Preferably fan housing 50 comprises radially outwardly projecting connecting parts 60; tubular installation part 14 comprises spring elements 28 for a latching connection in order to bring about, together with the radially protruding connecting parts, a latching connection between installation element 10 and fan arrangement 40 upon mounting of fan housing 50.

Preferably fan housing 50 comprises at second housing part end 52 an outwardly projecting collar 58 in order to enable fan housing 50 to be grasped and turned by hand. Radially outer contour 59 of collar 58 is preferably of undulating configuration.

Preferably fan housing 50 is implemented to receive a fan 81 having connecting wires 92; and fan housing 50 comprises a second aperture 64, 64' that is implemented to enable passage of connecting wires 92 through second aperture 64, 64'.

Preferably second aperture 64, 64' is arranged at least in part on that half of tubular housing part 54 which faces toward second housing part end 52.

Preferably second aperture 64, 64' of fan housing 50 is implemented to prevent connecting wires 92 from slipping out of second aperture 64, 64' toward first housing part end 51.

Preferably fan housing 50 comprises an elongated opening 62 that extends from first housing part end 51 of tubular housing part 54 toward second housing part end 52 in order to enable wires to be laid into elongated opening 62 from first housing part end 51. The length of elongated opening 62 is preferably greater than half the axial extent of tubular housing part 54.

Preferably elongated opening 62 is connected, at its end facing toward second housing part end 52 of tubular housing part 54, to second aperture 64, second aperture 64 comprising, with respect to elongated opening 62, an enlargement 64 in a circumferential direction in order to prevent wires from slipping out of elongated opening 62.

Preferably the fan housing is implemented to enable introduction of a tubular air guidance part 84 into tubular housing part 54.

Preferably fan housing 50 comprises, on tubular housing part 54, latching elements 66 that are implemented to enable axial securing of tubular air guidance part 84 in tubular housing part 54. Latching elements 66 preferably have a contact surface 67 that is implemented to interact with a contact countersurface 84' of tubular air guidance part 84 in such a way that contact surface 67 and contact countersurface 84' are not parallel to one another, in order to reduce play between fan housing 50 and air guidance part 84.

Preferably fan housing 50 is connected to a tubular air guidance part 84 that is arranged at least in part in tubular housing part 54.

Preferably tubular air guidance part 84 comprises struts 86, 86' on which an electric motor 80 having connecting wires 92 is mounted. At least one strut 86' preferably comprises a first channel 89 for guidance of connecting wires 92 in first channel 89.

Preferably a mounting apparatus having a second aperture has an air guidance part 84 that comprises at the outer periphery a second channel 98, and connecting wires 92 extend from electric motor 80 through second channel 98 to second aperture 64 and through the latter to the outer side of tubular housing part 54, in order to enable electrical contacting of electric motor 80. Second channel 98 preferably extends over at least 50% of the axial extent of the air guidance part.

Preferably fan housing 50 is connected, preferably releasably connected, to the installation element. Connecting wires 92 preferably extend through second channel 98, through second aperture 64, and through first cutout 26.

Preferably the mounting apparatus is connected to a vehicle seat. The vehicle seat is preferably connected to a vehicle.

The invention claimed is:

1. A mounting apparatus (30) for mounting a fan arrangement (40) on a seat (100), which mounting apparatus (30) comprises an installation element (10) and a fan housing (50) for the fan arrangement (40), the fan housing (50) including a tubular housing part (54) having a first housing part end (51) and a second housing part end (52) located opposite it, a protective grid (56) being provided at the second housing part end (52), said grid being configured to enable the transport of air through the tubular housing part (54); and the installation element (10) comprising a tubular installation part (14) having a first installation part end (11) and a second installation part end (12) located opposite it, a protective grid (18) being provided at the first installation part end (11), said grid being configured to enable the transport of air through the tubular installation part (14);

at least one outwardly projecting flange (20), which is implemented to form, upon installation of the installation element (10) with a surface (22) facing toward the second installation part end (12), a stop relative to an element of the seat (100), being provided at the first installation part end (11) on the outer side of the tubular installation part (14); and the installation element (10) being shaped in such a way that, after installation thereof on a seat (100), introduction of the tubular housing part (54) of the fan housing (40) into the tubular installation part (14) is possible from the second installation part end (12) thereof.

2. The mounting apparatus according to claim 1, in which the installation element comprises at least one mounting element (24, 22) that is configured to secure the installation element (10) axially in an aperture of the seat (100).

3. The mounting apparatus according to claim 2, in which the at least one mounting element (24, 22) is implemented to secure the installation element (10) against rotation in an aperture of the seat (100).

4. The mounting apparatus according to claim 2, in which the at least one mounting element (24, 22) comprises a hook-shaped element (24) that is implemented to enable introduction of the installation element (10) into the aperture of the seat (100) in a direction from the first installation part end (11) toward the second installation part end (12), but to counteract a movement in the opposite direction.

5. The mounting apparatus according to claim 1, in which the radial extent of the flange (20) is smaller in a first angular region than in a second angular region, and no flange is provided in at least one third angular region.

6. The mounting apparatus according to claim 1, in which the installation element (10) is provided for mounting a fan arrangement (40) having connecting wires (92), a first cutout (26) being formed in the second installation part end (12) in order to enable the connecting wires (92) to be arranged in said first cutout (26) upon mounting of the fan arrangement (40).

7. The mounting apparatus according to claim 6, in which the installation element is configured to enable, for installation of the fan arrangement (40), a rotary movement of the fan housing (50) relative to the installation element (10), the first cutout (26) being sufficiently large that in the context of the rotary movement, a rotary movement of the connecting wires inside the first cutout (26) is possible.

8. The mounting apparatus according to claim 1, in which the fan housing (50) has radially outwardly projecting connecting parts (60); and in which the tubular installation part (14) comprises spring elements (28) adapted to engage as a latching connection, in order to bring about, together with said radially protruding connecting parts (60), a latching connection between the installation element (10) and the fan arrangement (40) upon mounting of the fan housing (50).

9. The mounting apparatus according to claim 1, in which the fan housing (50) comprises, at the second housing part end (52), an outwardly projecting collar (58) in order to enable the fan housing (50) to be grasped and turned by hand, the radially outer contour (59) of the collar (58) being of undulating configuration.

10. The mounting apparatus according to claim 1, in which the fan housing (50) is configured to receive a fan (81) having connecting wires (92); and the fan housing (50) comprises a second aperture (64, 64') that is adapted to enable passage of the connecting wires (92) through the second aperture (64, 64').

11. The mounting apparatus according to claim 10, in which the second aperture (64, 64') is arranged, at least in part, on that half of the tubular housing part (54) which faces toward the second housing part end (52).

12. The mounting apparatus according to claim 10, in which the second aperture (64, 64') of the fan housing (50) is configured to prevent the connecting wires (92) from slipping out of the second aperture (64, 64') toward the first housing part end (51).

13. The mounting apparatus according to claim 10, in which the fan housing (50) is formed with an elongated opening (62) that extends from the first housing part end (51) of the tubular housing part (54) toward the second housing part end (52) in order to enable wires to be laid into the elongated opening (62) from the first housing part end (51), the axial length of the elongated opening (62) being greater than half of an axial extent of the tubular housing part (54).

14. The mounting apparatus according to claim 13, in which the elongated opening (62) is connected, at its end facing toward the second housing part end (52) of the tubular housing part (54), to the second aperture (64), the second aperture (64) comprising, with respect to the elongated opening (62), an enlargement (64) in a circumferential direction in order to prevent wires from slipping out of the elongated opening (62).

15. The mounting apparatus according to claim 1, in which the fan housing is shaped to enable introduction of a tubular air guidance part (84) into the tubular housing part (54) and is formed, on its tubular housing portion (54), with latching elements (66) adapted to engage radially and thereby axially secure said tubular air guidance part (84) within said tubular housing part (54).

16. The mounting apparatus according to claim 15, in which the latching elements (66) have a contact surface (67) that is configured to interact with a contact countersurface (84') of the tubular air guidance part (84) in such a way that the contact surface (67) and the contact countersurface (84') are not parallel to one another, in order to reduce play between the fan housing (50) and the air guidance part (84).

17. The mounting apparatus according to claim 15, in which the fan housing (50) is connected to a tubular air guidance part (84) that is arranged, at least in part, in the tubular housing part (54).

18. The mounting apparatus according to claim 17, in which the tubular air guidance part (84) comprises struts (86, 86') on which an electric motor (80) having connecting wires (92) is mounted, at least one strut (86') defining a first channel (89) for guidance of connecting wires (92) in the first channel (89).

19. The mounting apparatus according to claim 18, having a second wire passage aperture (64) in which the air guidance part (84), along an outer periphery thereof, is formed with a second channel (98); and in which the connecting wires (92) extend from the electric motor (80) through the second channel (98) to the second aperture (64) and through the latter to the outer side of the tubular housing part (54), in order to enable electrical contacting of the electric motor (80), the second channel (98) extending over at least 50% of the axial extent of the air guidance part.

20. The mounting apparatus according to claim 19, in which the fan housing (50) is connected to the installation element; and in which the connecting wires (92) extend through the second channel (98), through the second aperture (64), and through the first cutout (26).

* * * * *